US006352087B1

(12) United States Patent
Roelstraete

(10) Patent No.: US 6,352,087 B1
(45) Date of Patent: Mar. 5, 2002

(54) INSERTION GRIPPER FOR A RAPIER LOOM

(75) Inventor: Kris Roelstraete, Zwevegem (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/784,443

(22) PCT Filed: Jul. 19, 1999

(86) PCT No.: PCT/EP99/05140

§ 371 Date: Feb. 26, 2001

§ 102(e) Date: Feb. 26, 2001

(87) PCT Pub. No.: WO00/12797

PCT Pub. Date: Mar. 9, 2000

(30) Foreign Application Priority Data

Aug. 26, 1998 (DE) ..... 198 38 781

(51) Int. Cl.[7] ..... D03D 47/23

(52) U.S. Cl. ..... 139/448

(58) Field of Search ..... 139/448

(56) References Cited

U.S. PATENT DOCUMENTS

| | | | | | |
|---|---|---|---|---|---|
| 4,417,606 | A | * | 11/1983 | Corain | 139/448 |
| 4,587,998 | A | * | 5/1986 | Egloff et al. | 139/448 |
| 5,341,852 | A | * | 8/1994 | Corain et al. | 139/448 |
| 5,558,133 | A | * | 9/1996 | Bortoli et al. | 139/448 |

* cited by examiner

*Primary Examiner*—Andy Falik
(74) *Attorney, Agent, or Firm*—Bacon & Thomas, PLLC

(57) ABSTRACT

A receiving gripper for a rapier loom. The gripper includes a hook (3) and a clamping element (5) cooperating with the hook. The clamping element (5) is guided along a curved guide path (13) between an open position and a clamping position by a guide (14, 15) along a curved guide path (13). The guide path is directed to the hook's clamping surface (4) when in the zone before the clamping position and when in the zone of clamping position including a section in which no transverse displacement is superposed on the motion of the clamping element (5).

6 Claims, 8 Drawing Sheets

INSERTION GRIPPER FOR A RAPIER LOOM

Figure 1:
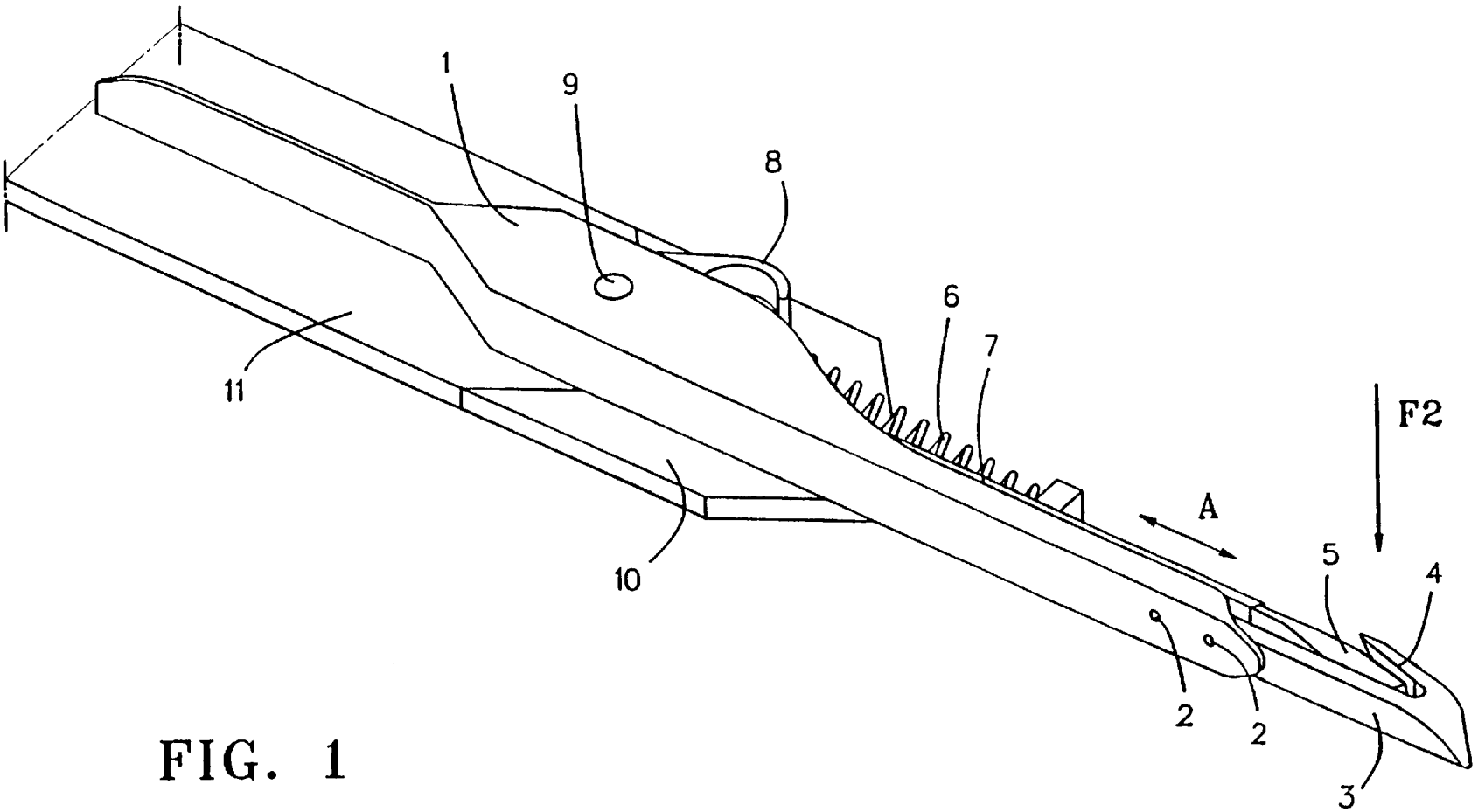

The present invention relates to a receiving gripper for a rapier loom, comprising a hook having on its inside a clamping surface extending obliquely to the longitudinal direction of the gripper, and a clamping element having a clamping surface associated with the hook's clamping surface, said clamping element being displaceable substantially in the longitudinal direction of the gripper against a spring from a clamped position into an open position and being supported and guided by a guide on the side which is opposite said clamping surface.

As regards a receiving gripper of the initially cited kind and illustratively described in British patent 2,106,550A, the clamping element will be guided along its direction of displacement. This design entails a comparatively large excursion for the element to reach its open position in order to release a filling.

It is known from the European patent document 0,123,005B to design the guide as an oblique, plane path running opposite the hook's clamping surface. As a result, the clamping element moving along this path will release a filling after a comparatively short opening displacement because an oblique, transverse displacement is carried out in addition to the longitudinal displacement of the clamping element.

When using a receiving gripper, the filling must be reliably kept in place between the clamping surfaces of the hook and the clamping element. The clamping forces must be large enough to preclude accelerations or decelerations from moving the clamping element out of its clamping position, or to be affected by external vibrations applied to the gripper. These forces are applied by a spring loading the clamping element. As regards the design of the European patent document 0,123,005, a comparatively stiff spring is required because the clamping element in its clamping position rests not only against the hook's clamping surface but also against the guide. The spring stiffness affects the loads of the clamping surfaces of the guide means and the other drive elements and connectors between a drive lever and the clamping element. High spring forces entail commensurately high stresses and wear. Accordingly the advantage of rapid release of a filling is a tradeoff against the drawback of higher wear in the design of the European patent document 0,123,005B1.

The objective of the invention is to create a receiving gripper of the initially cited kind which shall open rapidly while at the same time not be subjected to too high wear.

The invention solves this problem by guiding the clamping element between the open and clamped positions, using the guide, along a curved guide path which, in the zone before the clamping position, is directed toward the hook's clamping surface and which in the zone of the clamping position, changes over into a section substantially extending in the longitudinal direction of the gripper.

The curved guide path of the guide of the invention attains adequately high clamping forces using a comparatively compliant spring because the clamping element is supported practically solely at the clamping surfaces against the spring force. Nevertheless the curved guidance path allows superposing a relatively large transverse displacement on the longitudinal motion of the clamping element and as a result makes it possible to open the gripper comparatively rapidly.

Further features and advantages of the invention are elucidated in the following description of the illustrative embodiments shown in the drawings, and in the sub-claims.

Figure 2:
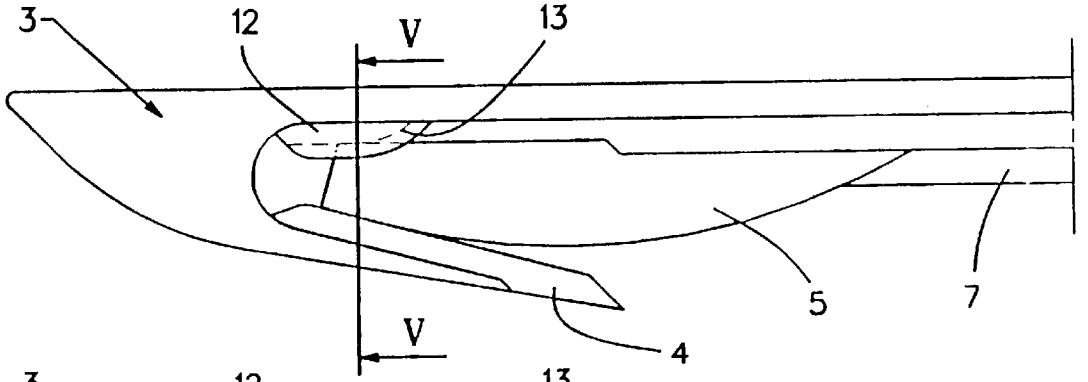
Figure 3:
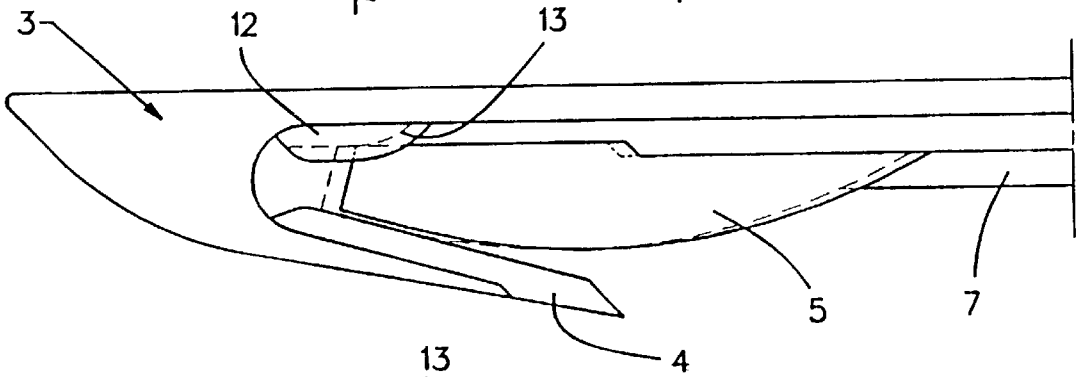
Figure 4:
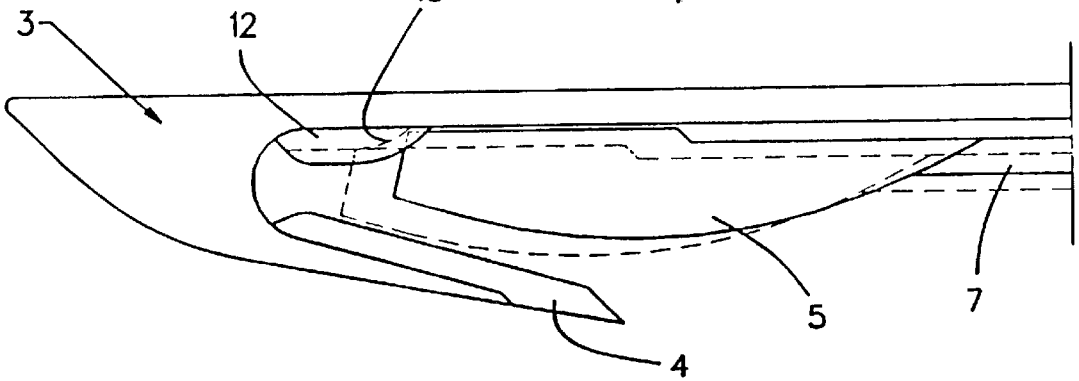
Figure 23:
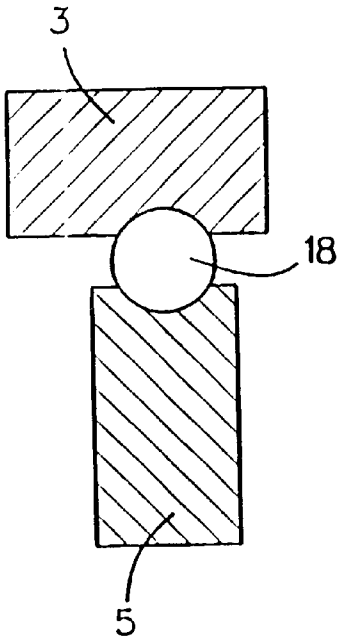
Figure 13:
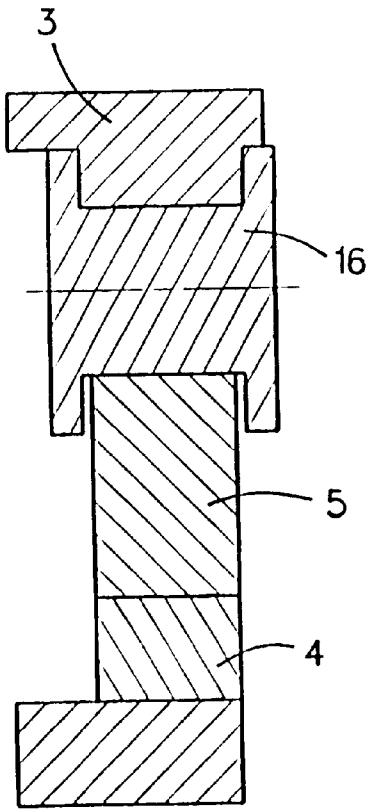
Figure 9:
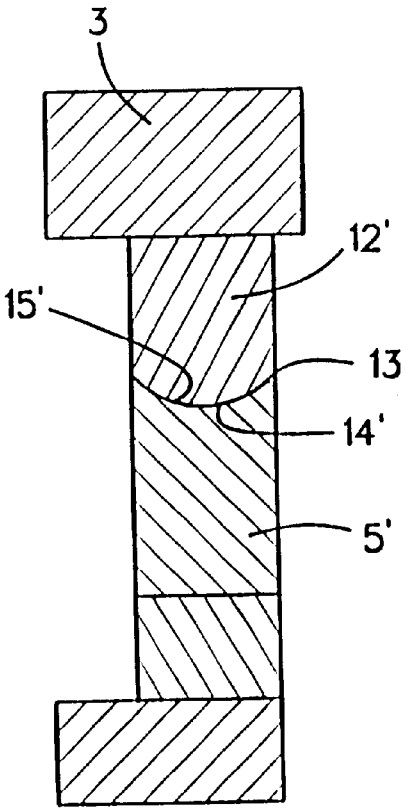
Figure 5:
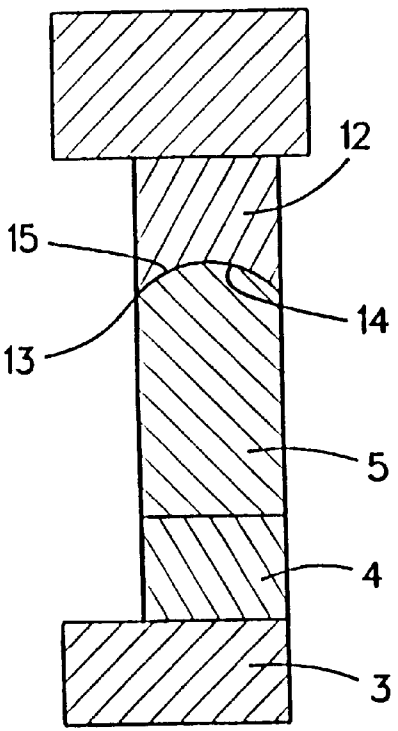
Figure 6:
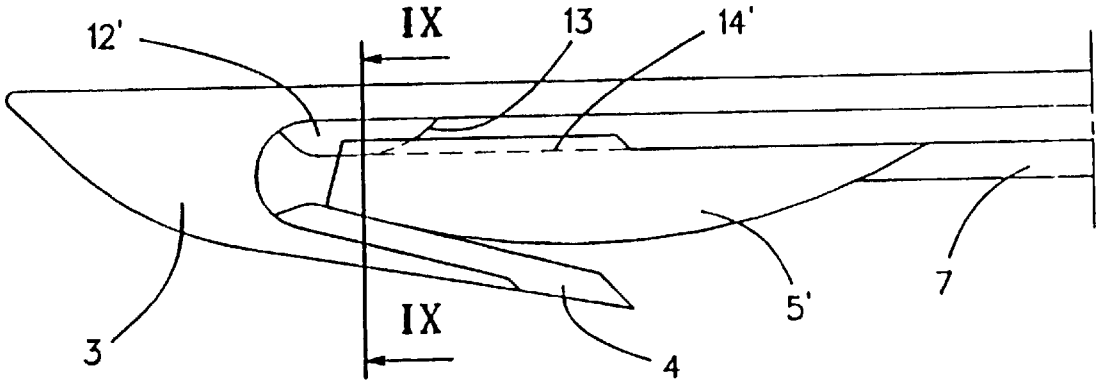
Figure 7:
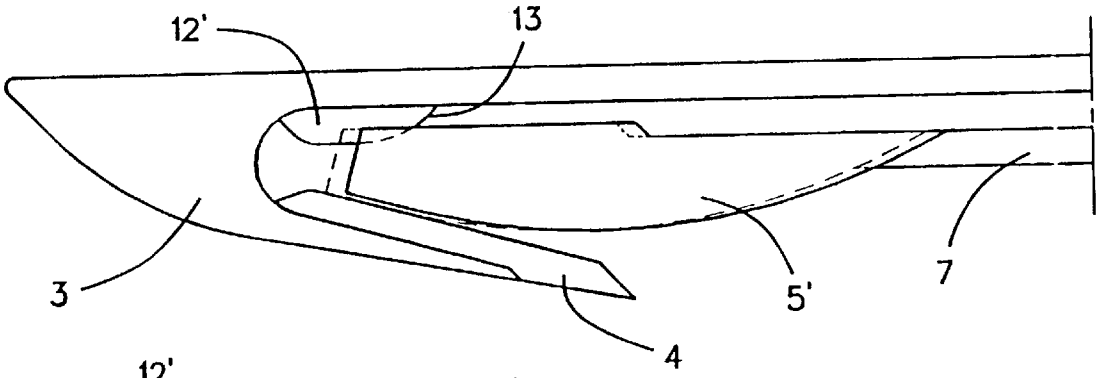
Figure 8:
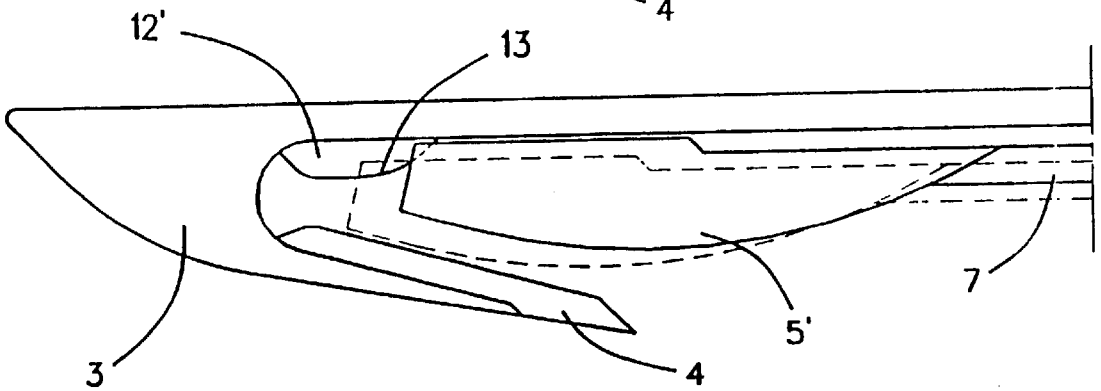
Figure 10:
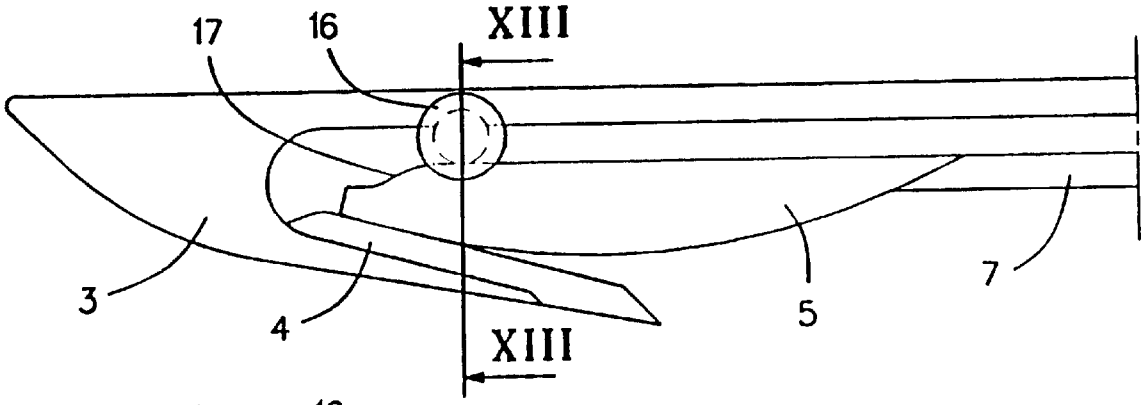
Figure 11:
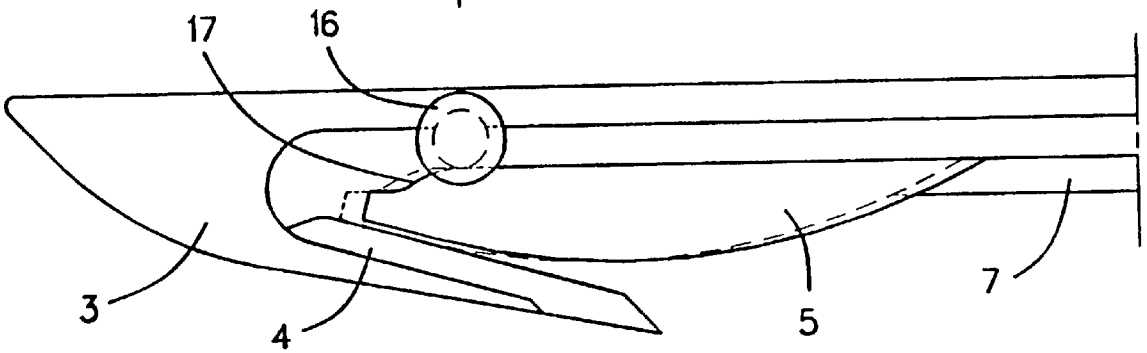
Figure 12:
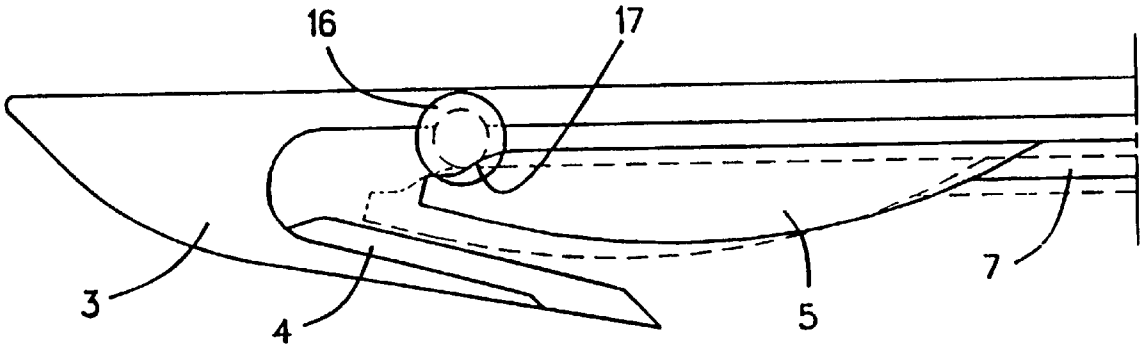
Figure 18:
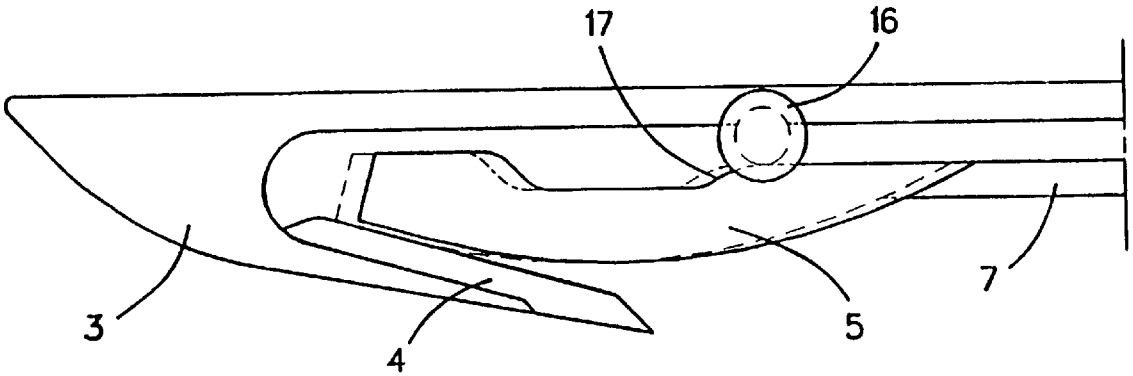
Figure 19:
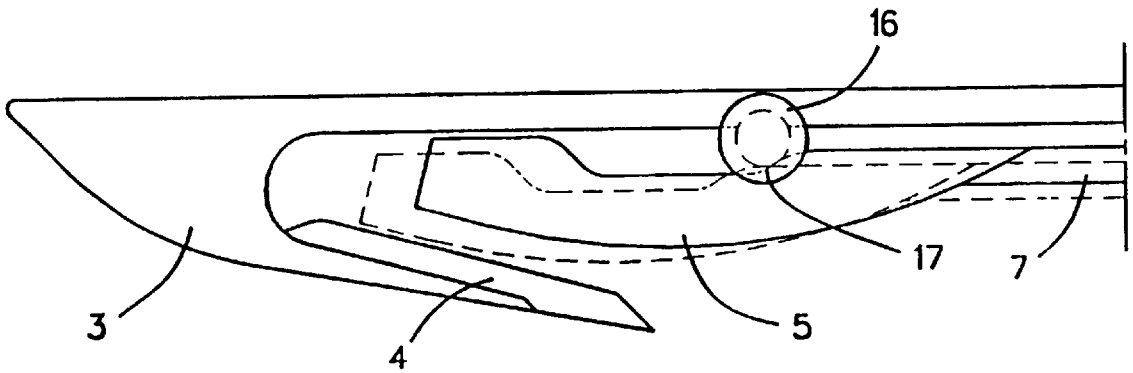
Figure 20:
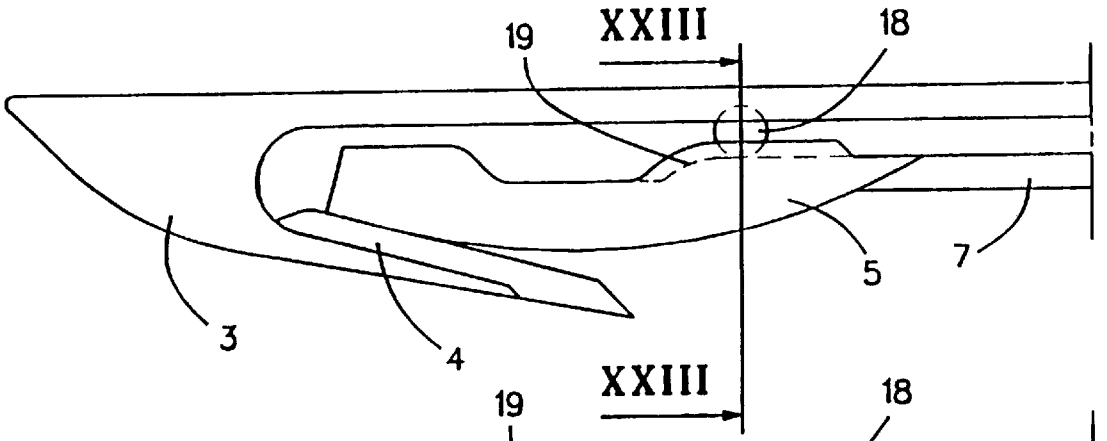
Figure 21:
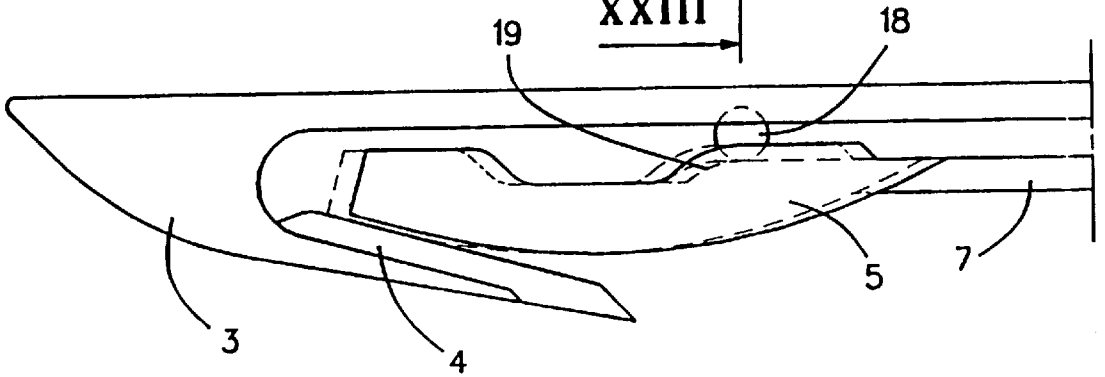
Figure 22:
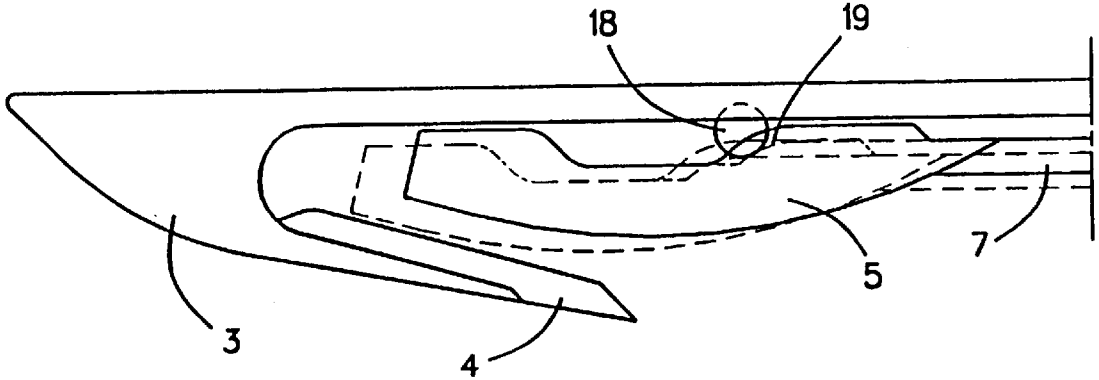

FIG. 1 is a perspective of a receiving gripper of the invention,

FIGS. 2–4 are elevations in the direction of arrow F2 of FIG. 1 of a first embodiment of a receiving gripper in its clamped position, in its open position and in an intermediary position, FIG. 5 is a section along line V—V of FIG. 2, FIGS. 6–8 are elevations of an embodiment similar to that of FIGS. 2–4, FIG. 9 is a section along line IX—IX of FIG. 6, FIGS. 10–12 are elevations of an embodiment comprising a roller guide for the clamping element, FIG. 13 is a section along line XIII—XIII of FIG. 10, FIGS. 14–16 are elevations of a further embodiment comprising a guide element retracted relative to the design of FIGS. 6 through 8, FIGS. 17–19 show an embodiment similar to that of FIGS. 10–13 comprising a roller-like guide element which is offset to the rear, FIGS. 20–22 are views of an embodiment comprising a spherical guide element, and FIG. 23 is a section along line XXIII—XXIII of FIG. 20.

The receiving gripper indicated in diagrammatic manner in FIG. 1 comprises a base structure 1 to the front end of which a hook 3 is affixed by screws 2. On its inside, this hook 3 is fitted with a clamping surface 4 running obliquely to the longitudinal gripper direction. Another clamping surface of a clamping element 5 is associated with said clamping surface 4, where said clamping element 5 is displaceable in the direction of the arrow A. The clamping element 5 is biased by a spring 6 toward the clamping surface 4 of the hook 3, said spring 6 acting through a not shown transmission mechanism, containing a transmission element 7, onto the clamping element 5. By actuating a lever 8 which is supported in the gripper structure 1 so as to be pivotable about a pivot 9, the clamping element 5 may be retracted for the purpose of releasing a filling. The gripper structure 1 of the receiving gripper is affixed to a guide 10 which extends a rapier 11.

In the present invention, both the design or configuration of the drive mechanism displacing the clamping element 5 in the direction of the arrow A and the kind of spring which biases the clamping element in the closing direction are of subordinate significance. Any known receiving gripper is applicable. What is significant is the kind of guidance imparted to the clamping element 5 in order to attain, on one hand, use of a comparatively weak biasing spring 6, and, on the other hand, a relatively rapid opening of the clamp constituted by the clamping element 5 and the hook 3. The spring 6 and any additional spring accessory not only assure biasing the clamping element 5 toward the end of the hook 3, but also that a spring force shall be transversely exerted on the clamping element 5 to load the clamping element away from the clamping surface 4 of the hook 3.

In the embodiment shown in FIGS. 2 through 5, the clamping element 5 is fitted with a curved clamping surface of which the clamping zone runs substantially parallel to the planar clamping surface 4 of the hook 3 consisting of an inset. The clamping surface 4 runs obliquely to the direction of motion of the clamping element 5.

On the side opposite the clamping surface 4, the clamping element 5 is guided by a guide 12 which also is designed as an inset fitted onto the hook 3. Together with the portion of the clamping element 5 associated with it, the guide element 12 constitutes a curved guide path 13. This guide path 13 initially runs toward the tip of the hook 3 at a comparatively marked curvature toward the clamping surface 4 of the hook 3 and then merges into a section running parallel to the direction of motion of the clamping element 5, that is in the longitudinal direction of the receiving gripper. Said curvature illustratively is in the form of a second-degree or higher order parabola or in the form of an arc of circle.

In the clamped position, shown in FIG. 2, the loading by the spring 6 is substantially absorbed between the hook's clamping surface 4 and the clamping surface of the clamping element 5, as a result of which a relatively large spring force may be derived from a relatively weak spring 6. Consequently, using a comparatively weak spring 6, a filling may be reliably held without incurring the danger of the clamping element 5 detaching from the clamping surface 4 on account of accelerations/decelerations and/or external forces. Because the applied spring force is small, the loading on the clamping surfaces and on the guide will be commensurately small and wear shall thus be reduced accordingly. The remaining components, for instance the pivot 9, also are stressed only little.

As shown in particular by FIG. 5, the clamping element 5 is guided by means of a rounded rib 14 in a corresponding longitudinal channel 15 of the guide element 12 in order to constitute the guide 13 As a result, the clamping element 5 also shall be guided transversely to the clamp motion. Because of the rounded rib 14 and the matched rounded longitudinal channel 15, the clamping element 5 is able to rotate to some extent about its longitudinal axis, whereby the clamping surface of the clamping element 5 is able to match the hook's clamping surface 4. On account of this round contour, manufacturing tolerances may be comparatively generous. If the guide path 13 consisted of planar surfaces, the tolerances would have to be narrow.

The embodiment of FIGS. 6 through 9 in principle is alike that of FIGS. 2 through 5. However the difference is that in the design of FIGS. 6 through 9, the guide element 12' is in the form of a rounded longitudinal rib 15', whereas the clamping element 5 is commensurately fitted with a rounded longitudinal channel 14'. The latter design also offers the same advantages as already described in relation to FIGS. 2 through 5.

In the embodiments of FIGS. 10 through 13, the hook 3 is fitted with a guide element in the form of a roller 16 which is affixed in stationary manner to, or rotatable supported in, the hook 3. In order to provide a curved guide path 17 in this embodiment, the end of the clamping element 5 situated opposite the roller 16, and, facing the hook 3, shall be appropriately contoured. When in the clamped position, the roller 16 cooperates with a segment running parallel to the direction of motion of the clamping element 5 or to the longitudinal direction of the entire receiving gripper. Said segment is preceded by a curved zone and as a result, following a relatively short excursion, the clamping element 5 can be rapidly displaced away from the clamping surface 4 or also can be rapidly returned to this clamping surface 4.

As regards the embodiments of FIGS. 2 through 5, 6 through 9 and 10 through 13, the guide elements 12, 12' and 16 are configured in the zone of the hook 3 opposite the clamping surface 4. However, and as shown in the embodiments of FIGS. 14 through 16, 17 through 19 and 20 through 22, said guide elements also are easily mounted elsewhere.

Figure 14:
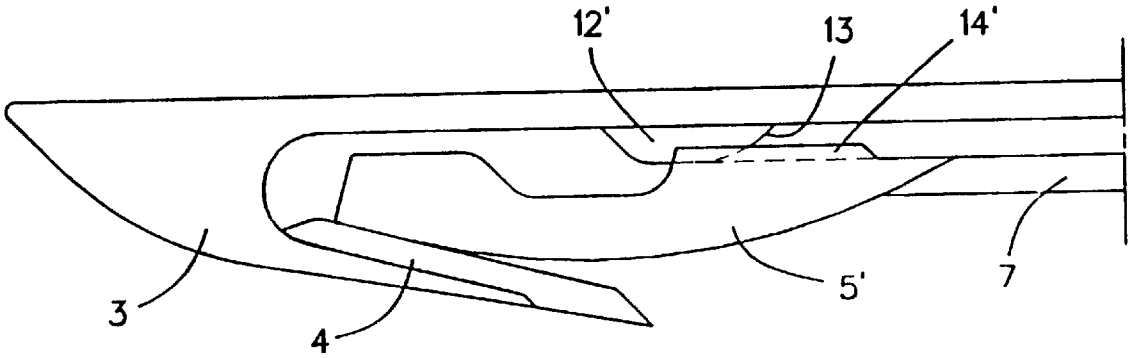
Figure 15:
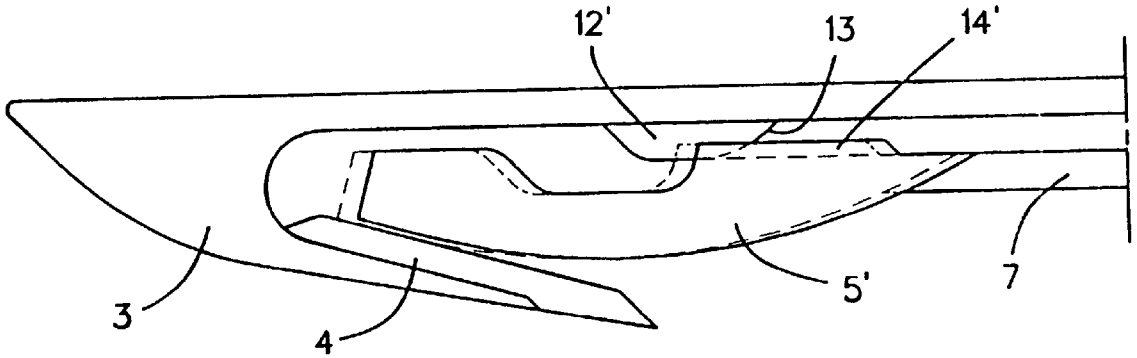
Figure 16:
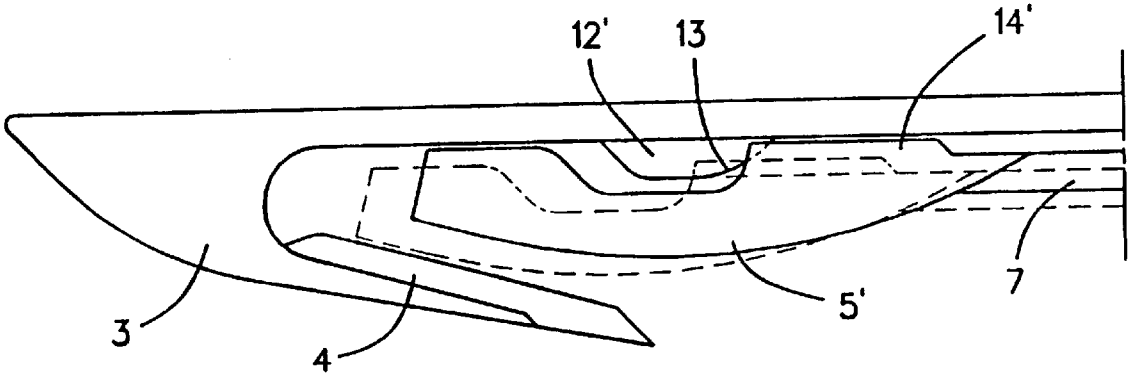

In the embodiment of FIGS. 14 through 16, a guide element 12' is shifted as shown in the embodiment of FIGS. 6 through 9 from the clamping surface 4 of the hook 3 in the direction of the lever 8.

Figure 17:
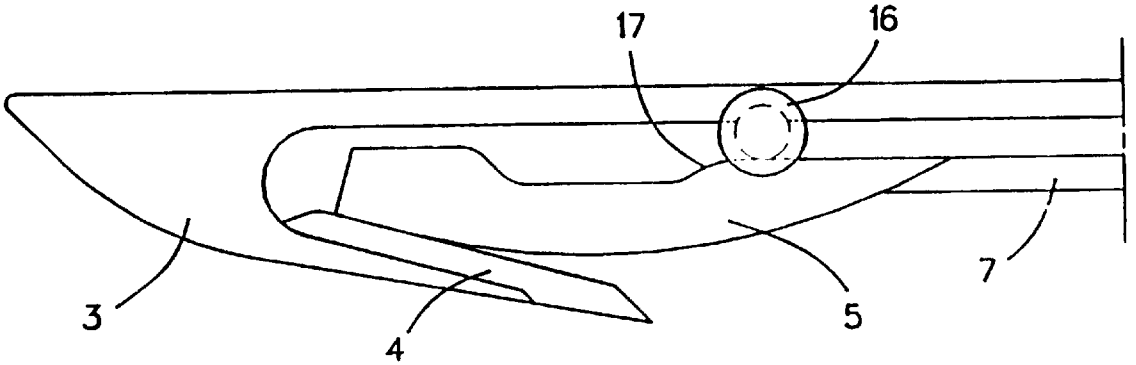

In the embodiment of FIGS. 17 through 19, a roller 16 corresponding to the embodiment of FIGS. 10 through 13 is offset from the clamping surface 4 of the hook 3.

Again as regards the embodiment of FIGS. 20 through 23, a spherical guide element 18 is offset from the clamping surface 4 of the hook 3. This ball 18 is associated with a guide path 19 similar to the guide path 17, said path 19 also being commensurately offset from the clamping surface 4. As shown clearly in particular in FIG. 23, this guide path 19 exhibits a cross-sectionally approximately half-circular channel.

In an embodiment variation similar to that of FIGS. 2 through 5, the guide element 12 constitutes an inset which is integral with the clamping surface 4 and is inserted into the hook 3.

In all embodiments, the guide path 13, 17, 19 shall run in the zone of the clamped position, in the direction of motion of the clamping element 5, that is, in the receiving gripper's longitudinal direction. As a result, the motion of the clamping element in this zones takes place in the absence of superposed transverse displacement relative to the clamping surface 4 of the hook 3. This goal also may be attained by the guide path deviating, within the zone of clamped position of the clamping surface, from the longitudinal gripper direction, in other words, a transverse displacement away from the clamping surface 4 is superposed on the clamping element 5 in the zone of clamped position.

Except for the embodiments shown in FIGS. 10 through 13, the clamping element 5 may always rotate to some extent about its longitudinal axis. As a result the clamping element can align itself by its clamping surface parallel to the clamping surface 4 of the hook 3 and in this manner it is able to reliably clamp a filling over a substantial length, the clamping force being uniformly distributed over said filling length.

The above discussion shows that the core of the invention is to be construed in the manner guiding the clamping element 5 before and when it reaches its clamping position. With such components the clamping element 5 will be loaded longitudinally toward the hook 3 and/or how the clamping element 5 may be retracted from the hook 3, is substantially of secondary significance. Therefore very many different designs are conceivable with which to implement this sort of motion.

What is claimed is:

1. A receiving gripper for a rapier loom, comprising a hook (3) having on its inside a clamping surface (4) extending obliquely to the longitudinal direction of the gripper, and a clamping element (5) having a clamping surface facing the hook's clamping surface, said clamping element (5) being displaceable substantially in the longitudinal direction of the gripper against a spring (6) from a clamped position into an open position and being supported and guided by a guide on the side opposite the clamping surface, wherein the clamping element (5, 5') is guided by the guide between the open position and the clamped position along a curved guide path (13, 17, 19) which, in the zone before the clamping position, is directed toward the clamping surface (4) of the hook (3) and which, in the zone of the clamping position, changes over into a section substantially extending in the longitudinal direction of the gripper.

2. Receiving gripper as claimed in claim 1, wherein the clamping element (5, 5') is additionally guided by the guide transversely to the clamping motion.

3. Receiving gripper as claim in claim 2, wherein the guide comprises a guide element (12, 12', 16, 18) of the hook (3) and a guide element (14, 14') of the clamping element (5, 5'), said guide elements engaging one another and precluding traverse shifting from the longitudinal direction while allowing the clamping element (5, 5') to rotate about a longitudinal axis.

4. Receiving gripper as claimed in claim 3, wherein the guide elements (12, 12') of the hook (3) and of the clamping element (5, 5') are in the form of a rounded rib (14, 15') and a rounded channel (15, 14') which engage one another.

5. Receiving gripper as claimed in claim 1, wherein the guide is mounted in a zone opposite the clamping surface (4) of the hook (3).

6. Receiving gripper as claimed in claim 1, wherein the guide is offset to the rear of the hook (3).

* * * * *